United States Patent [19]

Vyprachticky

[11] Patent Number: 4,580,364

[45] Date of Patent: Apr. 8, 1986

[54] RIFLE CARTRIDGE MAGAZINE

[75] Inventor: Emil Vyprachticky, Arvada, Colo.

[73] Assignee: Dale E. Dieringer, Arvada, Colo. ; a part interest

[21] Appl. No.: 643,795

[22] Filed: Aug. 24, 1984

[51] Int. Cl.[4] ..... F41C 25/02

[52] U.S. Cl. ..... 42/50

[58] Field of Search ..... 42/50

[56] References Cited

U.S. PATENT DOCUMENTS

| | | | |
|---|---|---|---|
| 2,081,235 | 5/1937 | Hillyard | 42/50 |
| 2,777,235 | 1/1957 | Hopkins | 42/50 |
| 3,399,480 | 9/1968 | Rowe, Jr. | 42/50 |
| 3,577,860 | 5/1971 | Jestrabek | 42/50 |
| 4,127,954 | 12/1978 | Hausmann | 42/50 |
| 4,366,638 | 1/1983 | Ketterer et al. | 42/50 |
| 4,509,283 | 4/1985 | Chesnut | 42/50 |

FOREIGN PATENT DOCUMENTS

| | | | |
|---|---|---|---|
| 635534 | 11/1963 | Belgium | 42/50 |
| 406904 | 8/1966 | Switzerland | 42/50 |

*Primary Examiner*—Charles T. Jordan

*Attorney, Agent, or Firm*—Edwin L. Spangler, Jr.

[57] ABSTRACT

This invention relates to a rifle cartridge magazine for carrying and automatically feeding a plurality of rifle cartridges one at a time sequentially into the breech of a rifle characterized by a housing open at the top containing an arcuately-curved cartridge compartment therein sized and shaped to define a track effective to engage the front and rear ends of each cartridge and guide same into the breech, a pair of ribs depending from one face of the housing and extending into the cartridge compartment in spaced parallel relation to one another defining rails paralleling the front and rear ends of the track located in between the latter, a follower provided with spaced parallel slots extending transversely thereof on one side for riding the rails, the aforementioned slots and rails cooperating with one another to maintain the follower in substantially perpendicular relation to the track ends, and at least one constant force coiled clock spring having one end pivotally secured adjacent the open upper end of the housing and its other end terminating in a free-standing coil hanging down inside the cartridge compartment, the follower having a pocket formed therein opening toward the face of the housing to which the spring end is secured, such pocket being sized to receive the coiled end of the latter, and the spring being operative with its coiled end thus retained in the pocket to pull the follower upwardly along the rails with a relatively constant force thereby pushing the cartridges ahead thereof into position the enter the breech.

6 Claims, 4 Drawing Figures

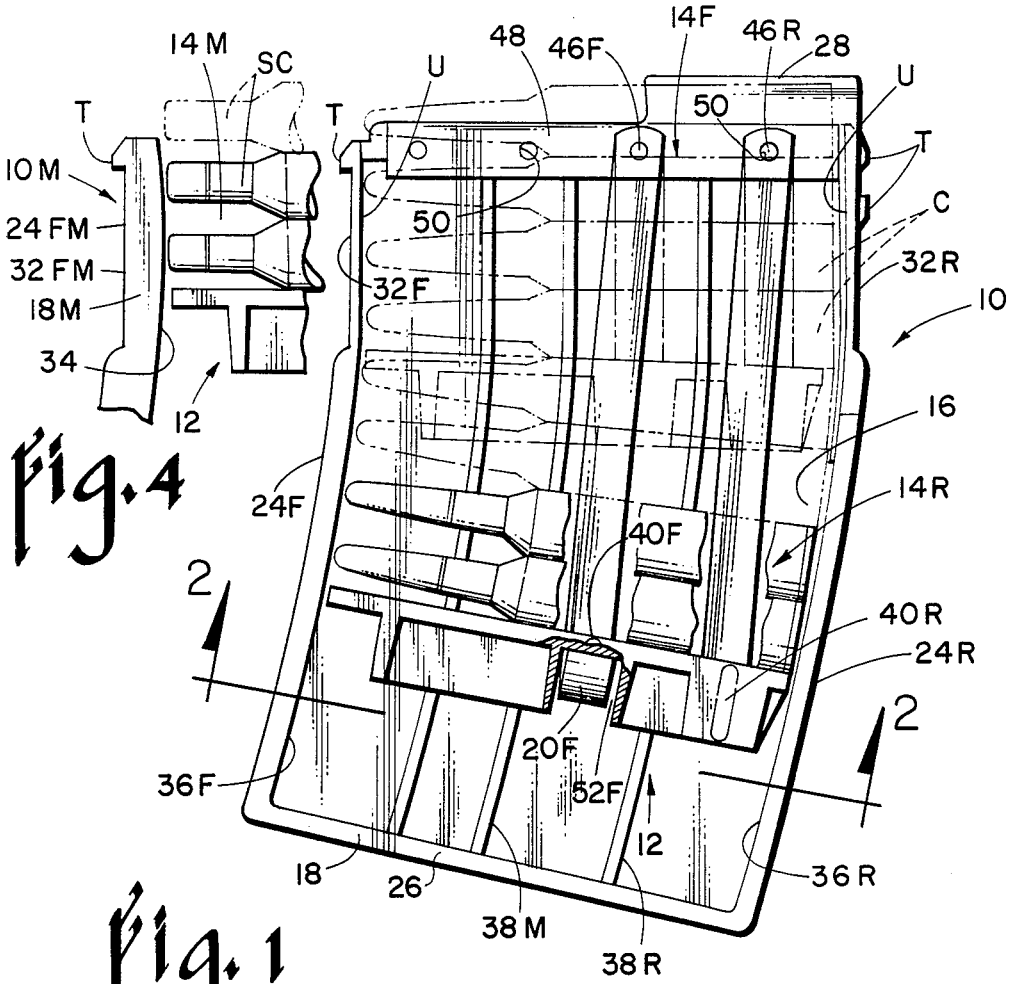
Fig. 4
Fig. 1
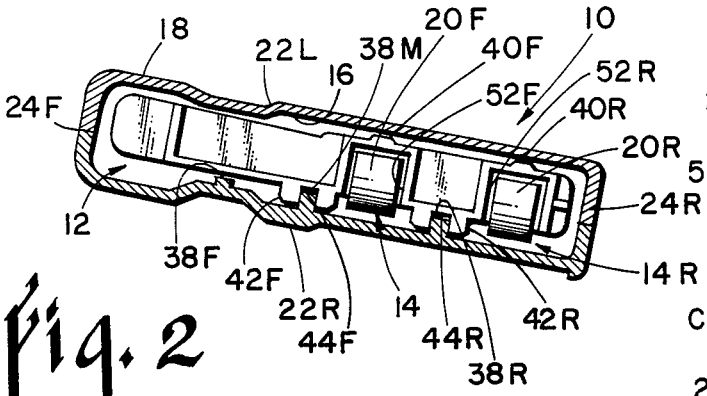
Fig. 2
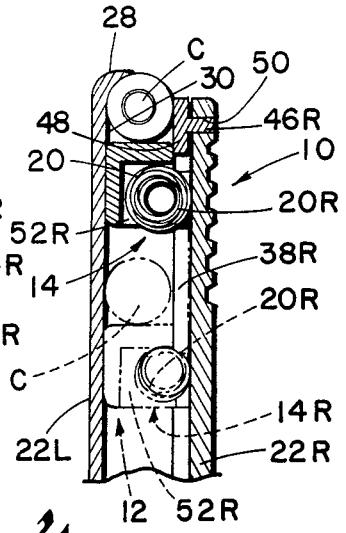
Fig. 3

RIFLE CARTRIDGE MAGAZINE

Among the widely advertised shooter's accessories are multiple-cartridge clips or, more properly, "magazines" that increase severalfold the normal capacity of a particular firearm without having to reload, be it a pistol or rifle. Revolvers, of course, already have a multiple-cartridge capacity as do many hand guns that carry a clip in the handle. Quite a number of rifles, on the other hand, are designed to fire only a single cartridge, or at most four or five, before it becomes necessary to reload. Several of these same rifles, however, are designed to accommodate a magazine containing as many as twenty cartridges. Access to the breech is usually provided for in the form of a bottom-opening slot sized and shaped to accommodate a magazine that releasably fastens therein. Suitable tracks or guideways position the magazine such that the bolt or other cartridge-feeding mechanism is in position upon actuation to engage the rear end of the uppermost cartridge accessible through the open top thereof and shove it into the breech.

The prior art magazines take several forms. For example, some are generally rectangular in shape while other so-called "banana" magazines are curved, the curvature accommodating the greater diameter of the cartridges at the rim than at the bullet end which, of course, causes them to "fan-out" so to speak instead of lying parallel to one another when placed in side-by-side contacting relation. While this "fanning out" is most prevalent in those rifle cartridges where the diameter of the case is greater than the diameter of the bullet, nevertheless, it still is evident in, for example, much of the pistol ammunition where both the bullet and its case except for the rim are essentially the same diameter.

Still other magazines have a parallelogram shape and some combine more than one shape. For instance, depending upon the particular make of gun, the length of the cartridge and the space available in the breech to accommodate the magazine, sometimes that portion of the latter which is housed inside the gun must have straight and parallel front and rear ends even though the portion outside the gun can be curved. Even the retangular or parallel gram-shaped magazines have curved cartridge compartments inside provided of course, that the length of the cartridge versus the length of the breech allows this to be done.

There remains yet another relatively common distinction between the different types of magazines and that is the arrangement of the cartridges within the cartridge compartment housing them. Quite often the cartridges are alternately offset to one side or the other thus forming two staggered rows of them in more or less nested side-by-side relation. The alternative arrangement is to stack the cartridges in a single aligned row. While the latter arrangement results in fewer cartridges being stackable in a magazine of a given length, the single-row magazine is thinner and can also be shown to provide a much more dependable feed with less jamming and cartridge misalignment.

All of the rifle magazines known to applicant share, at least to a greater or lesser extent, a common problem of occasionally jamming as a spring-actuated follower inside the cartridge compartment pushes the cartridges up toward the open top where they are in a position to be picked up by the bolt or other cartridge-feeding mechanism. Applicant has even found some units in which the cartridges become so misaligned that the top one will miss the breech entirely and slide down in front of the others. Intimately associated with the aforementioned jamming problem is the fact that insofar as applicant is aware all the rifle magazines currently available push the follower upward with a variable-force spring of some type located underneath such as, for example, a simple loose-wound helical compression spring. By so doing, the initial force required to depress the follower and insert the first cartridge may be only a pound or two, whereas, it goes up steadily and may end up as much as ten pounds by the time the last cartridge of the group is inserted and the spring is more or less fully compressed. Other types of variable-force springs positioned underneath the follower in a pushing relation to it suffer from the same shortcomings.

Applicant has now discovered in accordance with the teaching of the instant invention that these and other problems associated with the prior art rifle magazines can be overcome by the simple, yet unobvious, expedient of, first of all, carefully guiding the follower along tracks as it makes the excursion from the bottom of the cartridge compartment to the open top thereof while, at the same time, pulling it up with one or more constant-force coiled clock springs in place of the helical springs now used to actuate the follower. Also, by confining and thus maintaining the cartridges in a single vertically-aligned row, their tendency to overrun one another, pile up and jam is effectively eliminated.

It is, therefore, the principal object of the present invention to provide a novel and improved multiple-cartridge rifle magazine.

A second objective of the invention herein disclosed and claimed is the provision of a virtually jam-proof unit.

Another object is to provide a magazine for rifle cartridges that uses a coiled constant-force clock spring to pull the follower to the open top in place of a loose-wound helical compression spring therebeneath.

Still another objective of the within described invention is the provision of a rifle cartridge magazine which with but minor modifications can be made to accommodate cartridges of various lengths, shapes and calibers as well as the many makes of rifles designed to accept such magazines.

An additional object is the provision of a cartridge magazine of the type aforementioned which pulls rather than pushes the cartridges into position to be picked up by the cartridge-feeding mechanism of the rifle and does so maintaining a relatively constant force thereon at all times.

Further objects are to provide a rifle cartridge magazine that is versatile, easy to use, rustproof, transparent, rugged, safe, lightweight, compact and even decorative.

Other objects will be in part apparent and in part pointed out specifically hereinafter in connection with the drawings that follows, and in which:

FIG. 1 is a side elevation of the magazine, portions of the follower having been broken away and shown in section while some of the cartridges in the stack have been shown in phantom lines to more clearly reveal the interior construction;

FIG. 2 is a section taken along line 2—2 of FIG. 1;

FIG. 3 is a fragmentary section to an enlarged scale showing the details of the coil-spring-actuated follower which pulls the cartridges in the cartridge compartment into position to be picked up by the cartridge feeding mechanism of the rifle; and, FIG. 4 is a fragmentary side elevation to the same scale as FIG. 1 showing a modified form of the magazine in which the cartridge compartment is curved throughout its length as it can be to house the shorter blunt-nosed cartridges.

Referring next to the drawings for a detailed description of the present invention, and initially to FIGS. 1, 2 and 3 for this purpose, reference numeral 10 has been selected to designate the magazine broadly while numerals 12 and 14 have been similarly used to refer to the follower and coiled clock springs, respectively, that actuate the latter within the cartridge compartment 16 formed in housing 18. In the particular form illustrated, the housing is molded from a suitable plastic material, preferably one that is transparent so that the user can immediately tell whether there is a cartridge in it or not. The polycarbonate plastic material marketed under the trademark, among others, called "Lexan" has proven quite satisfactory as a material from which to fabricate the housing 18. Follower 12, on the other hand, is preferably made from one of the self-lubricating plastic materials like, for example, those sold under the trademarks Delrin or Nylon, the reason being that it holds the coiled end 20 of the clock spring 14 which rubs thereagainst in a manner that will be described in detail presently. Springs 14 are made of spring metal and coiled in the manner of a common clock spring. As such, these springs are commonly known as "constant-force springs" because of their inherent characteristic of exerting a nearly uniform force upon the load attached thereto, in this instance follower 12, regardless of the extent to which coiled end 20 is coiled.

Housing 18 includes right and left transversely-spaced sidewalls 22R and 22L, respectively, front and rear endwalls 24F and 24R, a bottom wall 26 and an overhanging lip 28 (FIGS. 1 and 3) that engages the rear end of the cartridge case of the uppermost cartridge C in the cartridge compartment 16 as shown and holds the latter in position for insertion into the breech of the rifle. The cartridge-feeding mechanism is conventional and has not been illustrated; however, it engages the rear end of the cartridge C which is exposed at the opening 30 at the top of the rear endwall 24R underneath the lip as seen in FIG. 3. The function of the follower in common with all such magazines is, of course, to bias the stack of cartridges up against the lip 28 where the feeding mechanism can engage and push them one-at-a-time forwardly upon actuation of the latter into the breech. Tabs or projections of one type or another indicated by the letter T in FIGS. 1 and 4 engage parts (not shown) inside the rifle which releasably hold the magazine 10 in place therein. These features form no part of the present invention and, of course, they vary with each rifle manufacturer.

With particular reference to FIG. 1, it can be seen that the upper end of the magazine where the tabs T are located have longitudinally-spaced Parallel straight, as opposed to curved, wall portions 32F and 32R. This is the portion of the magazine that is housed inside the rifle and shaped in accordance with the particular design of the manufacturer. It does become significant in the design of the magazine, however, because of severe space restrictions. For example, as revealed in FIG. 1, the overall length of the cartridges C in relation to that of a magazine 10 which will fit into the opening provided therefor in certain rifles, for example a 30-06 caliber, is such that the upper portion of the cartridge compartment U must also have straight walls when long-nosed cartridges like those shown are used. If, on the other hand, shorter snub-nosed cartridges like those shown in FIG. 4 are used, a good deal more material is available for the front and rear walls thus permitting the cartridge compartment to be reshaped.

FIG. 4 to which brief reference will now be made illustrates such a modification. The modified magazine 10M has a shorter cartridge compartment 14M housing the shorter cartridges SC of the same caliber. While housing 18M has the same exact shape and size on the outside, the shorter cartridge compartment allows the upper front endwall portion 32FM to be thicker and curved on the inside as shown at 34. The upper rear endwall (not shown) is, likewise, thicker and also curved instead of being straight. The curvature of these upper inside cartridge compartment wall portions in the 10M modification becomes a continuation of the curved inside lower cartridge compartment wall portion 36F and 36R of the magazine 10 of FIGS. 1, 2 and 3. If the cartridge compartment can be curved all the way to the top as shown in FIG. 4 regardless of the outside shape, such a construction is preferred since there is no shoulder formed between the straight and curved sections where the cartridges can hang up and jam.

The magazines 10 and 10M are both the so-called "banana-type" in which the cartridge compartment is curved and not straight. There is nothing novel about curving the cartridge compartment or the magazine itself since this has been done for years to accommodate the relatively smaller front end of the cartridge when compared to that of the rear end as they nest against one another in stacked relation. On the other hand, designing a follower and actuating spring for the latter that will accommodate this curvature without jamming is not all that simple. This problem, however, has been solved in accordance with the teaching of the instant invention in a unique, but nonetheless simple, manner which will now be described in detail by referring, once again to FIGS. 1, 2 and 3.

The front and rear cartridge compartment walls 36F and 36R parallel one another and are spaced apart a distance such that the stack of cartridges C, while guided, will be loosely-received therein as shown in FIG. 1. Paralleling these front and rear cartridge compartment walls at a location therebetween is at least one rib 38 projecting into the compartment from one of the sidewalls, in this case, right sidewall 22R. In the preferred embodiment shown, two such ribs 38M and 38R lying in longitudinally-spaced relation to one another are used. A third rib 38F lies forwardly of the middle rib 38M and cooperates with two projections 40F and 40R on the left side of the follower (see FIGS. 1 and 2) to maintain the latter element centered in the cartridge compartment as shown. Ribs 38 perform a different and most important function, namely, that of rails upon which the follower 12 rides and is guided during its excursion up and down the cartridge compartment.

The right side of the follower 12 is, in the particular form illustrated, formed with integral bosses 42F and 42R, each of which contains a slot 44F and 44R of a size and spacing to ride the rails 38M and 38R, respectively. With the rails of the housing and the slots of the follower thus interengaged, the follower is guided and prevented from tilting forward or backward so as to always remain in contact with and lie parallel to the lowermost or first cartridge inserted into the magazine.

Any tendency of the follower to tilt from side-to-side is prevented by the front rib 38F depending from the right sidewall of the housing engaging the right side of the follower and by the projections 40F and 40R on the left side of the latter riding against the left sidewall of the housing. As will be seen presently, the follower of the instant magazine has somewhat more of a tendency to tilt from side-to-side due to the off-center pull of the springs 14 than those prior art followers biased from underneath by a loose-wound helical compression spring which, for all practical purposes, engages the follower midway between its sides. It is significant, therefore, that follower 12 be provided with suitable guiding members like those described above that will keep it from tilting in any direction.

By far the most unique and important feature of the magazine being described herein is the use of coiled clock springs 14 to pull rather than push the follower against the cartridge stack. While one spring will work, two are preferred, both pivotally attached at one end to a sidewall of the housing (right sidewall 22R as shown) on pivot pins 46F and 46R. These pivot pins as shown are integrally-formed as parts of a strip 48 that extend along the top edge of right housing sidewall 22R. The latter sidewall is provided with a plurality of openings 50 sized and adapted to receive these pins. In FIG. 1 it can be seen that only the rear two pins are used as pivots to support the spring ends, the remaining ones merely being used to fasten strip 48 to the sidewall 22R with a suitable adhesive.

The side of the follower facing the sidewall to which the springs are fastened, in this instance the right side, is provided with side-opening pockets 52F and 52R sized to accept the coiled free ends 20F and 20R of springs 14F and 14R, respectively. These pockets must, of course, be large enough to loosely receive the largest diameter coils resulting when the follower is all the way to the top of the cartridge compartment and no cartridge is in the magazine. The coils each bear against the top wall of the pocket as shown in FIG. 3 as they coil and uncoil which is why a self-lubricating plastic is preferred. The pockets 52 are each shown open at the bottom as well as on one side. The purpose for doing so is to facilitate assembly of the magazine with the housing assembled since it is customarily molded in two parts. If, on the other hand, the pockets 52 were left closed at the bottom, it would be necessary to attach the springs to the sidewall and the follower to the coiled spring ends before the other of the two sidewalls was attached. In connection with FIG. 3, it can also be seen that strip 48 along the top of the sidewall 22R cooperates with the overhanging lip 28 on the left sidewall 22L to prevent the follower from escaping out the open top of the housing when no cartridge is present in the magazine.

Finally with brief reference to FIG. 1, it can be seen that it is important that the springs 14 be able to pivot since the follower follows an arcuate path as it moves up and down within the cartridge compartment. More specifically, looking at the full line representation of the follower in FIG. 1, it will be seen to occupy a position well forward of that it occupies near the upper end of its excursion represented by phantom lines. As it does so the springs will swing rearwardly on their pivots 46 from the forwardly-disposed full line position to a more nearly vertical one seen in phantom lines.

Also in connection with FIG. 1, the fact that the springs are secured near the rear end of the housing underneath the overhanging lip 28 is of significance since, in this location. The springs pull the rear ends of the cartridges up against this lip, not the open front end of the cartridge compartment where they might otherwise tilt rearwardly.

Loading of cartridges into the cartridge compartment is conventional in that the rear end of the cartridge is used to depress the follower beneath the overhanging lip, whereupon, it can be slid rearwardly underneath the latter all the way to the rear wall 32R. As each cartridge in turn is inserted, however, the force required to depress the follower remains essentially constant and does not increase as is the case with the prior art magazines.

I claim:

1. The rifle cartridge magazine which comprises: an open-topped housing having sidewalls, front and rear endwalls and a bottom wall cooperating with one another to define a hollow arcuately-curved cartridge compartment therein, said compartment being sized and shaped to accommodate a plurality of rifle cartrides stacked one above the other and maintain same in a single curved row with their front ends abutting said front wall and their rear ends abutting said rear wall; a follower housed within the curved cartridge compartment for arcuate movement therein between the bottom and open top thereof, said follower including a pocket at least partially covered on top; a coiled clock spring having one end seucred to a sidewall of the housing for pivotal movement forwardly and rearwardly and a coiled free end housed within the pocket, said spring normally biasing said follower upwardly by coiling against the covered top of the pocket and said pivotal connection accommodating the arcuate movement of said follower as it follows said curve; and means depending from one of the sidewalls partially covering the open top of the housing adapted to cooperate with the follower to prevent the cartridges from exiting upwardly therethrough while at the same time permitting them to be ejected forwardly.

2. The rifle cartridge magazine as set forth in claim 1 wherein: the pocket in the follower opens sideways to receive the coiled end of the spring and in which said spring is pivotally secured to the sidewall near the top thereof toward which said pocket opens.

3. The rifle cartridge magazine as set forth in claim 1 wherein: a curved upstanding rib projecting into the cartridge compartment depends from one of the sidewalls and in which the follower is slotted to receive said rib, said slot and rib when thus interengaged cooperating with one another to guide said follower during its arcuate travel between the bottom and top of the housing.

4. The rifle cartridge magazine as set forth in claim 1 wherein: the spring is aligned within the cartridge compartment beneath the means overhanging the open top of the housing.

5. The rifle cartridge magazine as set forth in claim 1 wherein: two springs are used spaced one forwardly of the other both of said springs are pivotally attached to the same sidewall, and in which the follower is provided with a separate pocket for the coiled end of each.

6. The rifle cartridge magazine as set forth in claim 3 wherein: two curved ribs project from said sidewall lying in spaced substantially parallel relation to one another and in which the follower is provided with dual guide slots to receive the latter.

* * * * *